US007787649B2

(12) United States Patent
Marsden et al.

(10) Patent No.: US 7,787,649 B2
(45) Date of Patent: Aug. 31, 2010

(54) FIXTURE FOR SPECIAL EFFECT LIGHTING

(76) Inventors: Michael B. Marsden, 28 W. 551 Garys Mill Rd., Winfield, IL (US) 60190; Donald A. Nebraske, 747 N. 117$^{th}$ St., Wauwatosa, WI (US) 53226

( * ) Notice: Subject to any disclaimer, the term of this patent is extended or adjusted under 35 U.S.C. 154(b) by 954 days.

(21) Appl. No.: 11/527,204

(22) Filed: Sep. 26, 2006

(65) Prior Publication Data

US 2007/0071270 A1 Mar. 29, 2007

Related U.S. Application Data

(60) Provisional application No. 60/721,055, filed on Sep. 28, 2005.

(51) Int. Cl.
*H04R 25/00* (2006.01)

(52) U.S. Cl. ..... 381/386; 381/87; 381/334

(58) Field of Classification Search ..... 381/87, 381/300, 304, 305, 332, 334, 335, 182, 386, 381/387, 390, 395; 181/144, 145, 150, 199; 248/282.1, 317, 323
See application file for complete search history.

(56) References Cited

U.S. PATENT DOCUMENTS 5,758,852 A * 6/1998 Martin ..... 248/282.1
5,996,728 A * 12/1999 Stark ..... 181/144
7,516,932 B2 * 4/2009 Engebretson et al. ..... 248/317

* cited by examiner

*Primary Examiner*—Huyen D Le
(74) *Attorney, Agent, or Firm*—Basil E Demeur; Alan B. Samlan; David J. Hurley

(57) ABSTRACT

The present invention is directed to a support fixture suitable for mounting on an underlying support structure such as a speaker box, and consists of a support platform having a fixed depending wall along one side edge thereof, and a bracket supporting a moveable wall opposed to the fixed wall. The top surface of the support platform is provided with a bridge having a slot formed thereunder, and an upstanding tube spaced from the bridge mounted thereon. The base of the upstanding support tube has opposed slots which are in horizontal registry with the slot in the bridge. A rod is provided which moves under the bridge slot and the opposed upstanding tube slot, a rod provided with a moveable wall. The support fixture is mounted upon and underlying support structure such as a speaker box by interposing a speaker box between a fixed depending wall, and the moveable support plate, and locked into position by lock means. Special effect lighting bars may then be mounted in and contained within the upstanding support tube and locked into position thereon.

8 Claims, 7 Drawing Sheets

FIXTURE FOR SPECIAL EFFECT LIGHTING

CROSS REFERENCE TO RELATED APPLICATION

The present application claims any and all priority rights to provisional application No. 60/721,055 filed Sep. 28, 2005, entitled Fixture for Special Lighting filed in the names of Michael B. Marsden and Donald A Neraske.

BACKGROUND OF THE INVENTION

The field of the present invention relates to a fixture intended to facilitate and reduce the number of physical items which appear on a stage incident to live concert performances. By way of background, a staged event especially a concert event generally will have a number of musicians forming a band or orchestra located on the stage. Incident to the performance, an array of fixtures are also present on the stage in order to enhance and direct the sound of the performers to the audience. For example, it is well known a number of box speakers are usually located on stage, in strategic locations, in order to direct the sound to the audience. In addition, and especially under current conditions, many performers and/or musical groups employ a variety of additional special effects devices incident to the performance of the concert. This is especially true with special effect lighting which is used to enhance and beautify the performance. A number of other devices are also employed up on stage, such as smoke machines and/or the pipe work necessary to produce smoke, where such live performances employ such special effects. The result is that the stage accommodating the performers and equipment becomes very congested in some instances, which has limited the venues where such performances may be produced. For example, smaller stages will not be able to accommodate a large orchestra with all the intended additional equipment including speakers, special effect lighting, and other special effect devices.

It has been observed that for those groups performing concerts requiring a plurality of speaker boxes, which also employs special effects lighting, the special effect lighting is generally mounted on tripods which are positioned on the stage in appropriate positions in order to produce the special lighting effect. Hence, in addition to positioning the speaker boxes on the stage, the stage must be sufficiently large to accommodate the positioning of the tripod arrangements with the special lighting effects. Additionally, in most instances, the special lighting effects require multiple tripods since there are multiple lights involved in a special effect display.

The present invention is intended to provide an improved fixture which will accommodate the mounting of special effect lighting thereon, the fixture intended and adapted to be mounted directly to the speaker boxes thereby eliminating the need entirely for a tripod arrangement for mounting the special effect lighting. This has the effect of reducing the space requirements necessary for both speakers and special effect lighting incident to the performance by a musical group employing such devices. The fixture of the present invention is adapted to be adjustable so that it can adjust to and mount upon virtually any size speaker box of the type generally employed at such performances.

By way of background, the art is virtually silent with respect to any types of fixtures which mount to speaker boxes for mounting additional special effects devices. The art shows various devices which mount to speaker boxes, but only for the purpose of enhancing the speaker quality. For example, U.S. Pat. No. 5,802,194 shows a speaker system which includes certain types of baffles mounted on base speaker boxes for the purpose of reducing or baffling the sound emanating from the speaker in order to enhance the primary sound. The patent discloses a permanent mounting of a baffling system which mounts to the speaker box in order to provide a speaker system capable of reducing the baffle effect and thereby increase the proportion of direct sound perceived from the speaker.

U.S. Pat. No. 5,714,723 illustrates a coupling bracket which mounts to speakers in order to couple a plurality of speakers together. As shown in FIG. 8 of the drawings, a number of speakers may be coupled together by using the coupling device of the -723 patent in order to secure the speakers together. Similar comments are apropos to the device shown in U.S. Pat. No. 5,758,852. The subject patent shows a rigging system which mounts to the speaker boxes, in order to afford one the ability to rig and suspend the speakers in order to direct the sound to the audience in a particular venue. Various figures show different arrangements of rigging speakers together by using the rigging system as defined in the -852 patent. Other devices which mount to a speaker box are shown in U.S. Pat. No. 5,996,728 which again is another variation of a speaker rigging system which operates to couple speakers together in order to rig them together and suspend them in vertical columns. This is used where a multiple array of speakers are required in order to achieve a certain sound quality and intensity incident to the concert or performance being produced. Similarly, U.S. Pat. No. 4,882,760 shows a system wherein a plurality of different range speakers are mounted to the top of the face speaker in order to emanate sound in a non-directional manner. The assembly is mounted to the top of a speaker box, but is generally fixedly secured thereto in order to provide a multi-speaker system which is interconnected.

At present, in order to mount special effect lighting on stage incident to production of a musical performance, the tripod arrangement is the method for deploying the special effect lighting. This requires that some space be provided on stage, to accommodate the positioning of each of the tripods holding special effect lighting. Hence, in addition to positioning speakers on stage, additional space is required for the tripod arrangement to accommodate the special effect lighting.

It will therefore be appreciated that the present invention is intended to provide a fixture which accommodates special effect lighting, but eliminates the need for any tripod stand for holding the special effect lighting in position. The fixture of the present invention is provided as an adjustable fixture which mounts to the top of any of the standard speaker boxes used incident to such musical live performances on stage, and will hold the special effects lighting above the speaker boxes. Hence, the fixture of the present invention reduces the amount of stage space required for the production of a musical performance.

OBJECTS AND ADVANTAGES

It is therefore the primary object of the present invention to provide an adjustable fixture for supporting an array of special effects lighting devices on stage incident to the production of musical or other performances. The fixture is a support for supporting the special effect lighting, and therefore eliminate the need for any other holding or supporting structure for supporting special effect lighting.

Incident to the object set forth above, the present invention provides a fixture assembly which consists of a support platform which is basically flat, having a depending sidewall along one side edge, and an assembly for providing a movable support wall at the opposed side edge opposed to the depending side wall. Appropriate lock means are provided for locking the removable wall into the support position once the fixture is mounted upon the top wall of an underlying support such as a speaker cabinet.

In conjunction with the foregoing object, a further object of the present invention is to provide a support fixture of the type described wherein a support platform is provided with a support bridge secured to the top surface thereof, and positioned opposite the depending wall, the support bridge having a slot thereunder, and wherein the top wall of the support platform includes a support tube having a base mounted on the top wall of the support platform and spaced a distance from the support bridge. The support tube includes opposed slots in the base of the support tube, the opposed slots being in spaced apart registry with the bridge slot when in its mounted position. A rod is provided which passes through the bridge slot and through the opposed tube base slots so that the arm is horizontally removable therethrough. The far end of the rod includes the moveable wall mounted therein so that the rod with the moveable wall is adjustable relative to the fixed depending wall in order to accommodate different sized speaker boxes thereunder.

The details of construction of the fixture of the present invention will be understood by reference of the accompanying drawings taken in conjunction with the following specification.

DETAILED DESCRIPTION OF DRAWINGS

Figure 1:
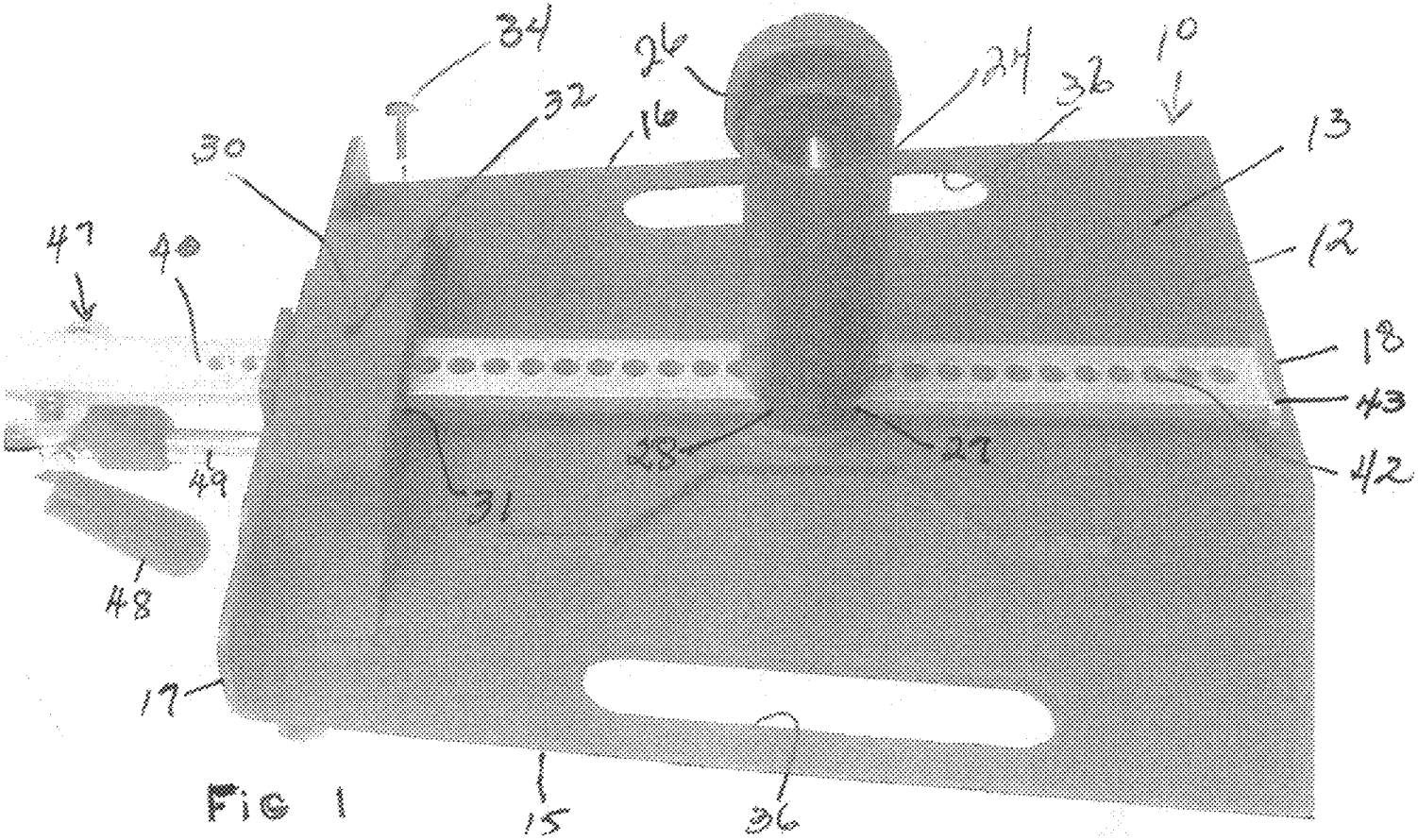
FIG. 1 is prospective view showing the support fixture of the present invention having the support tube extending upwardly from the support plate.
Figure 2:
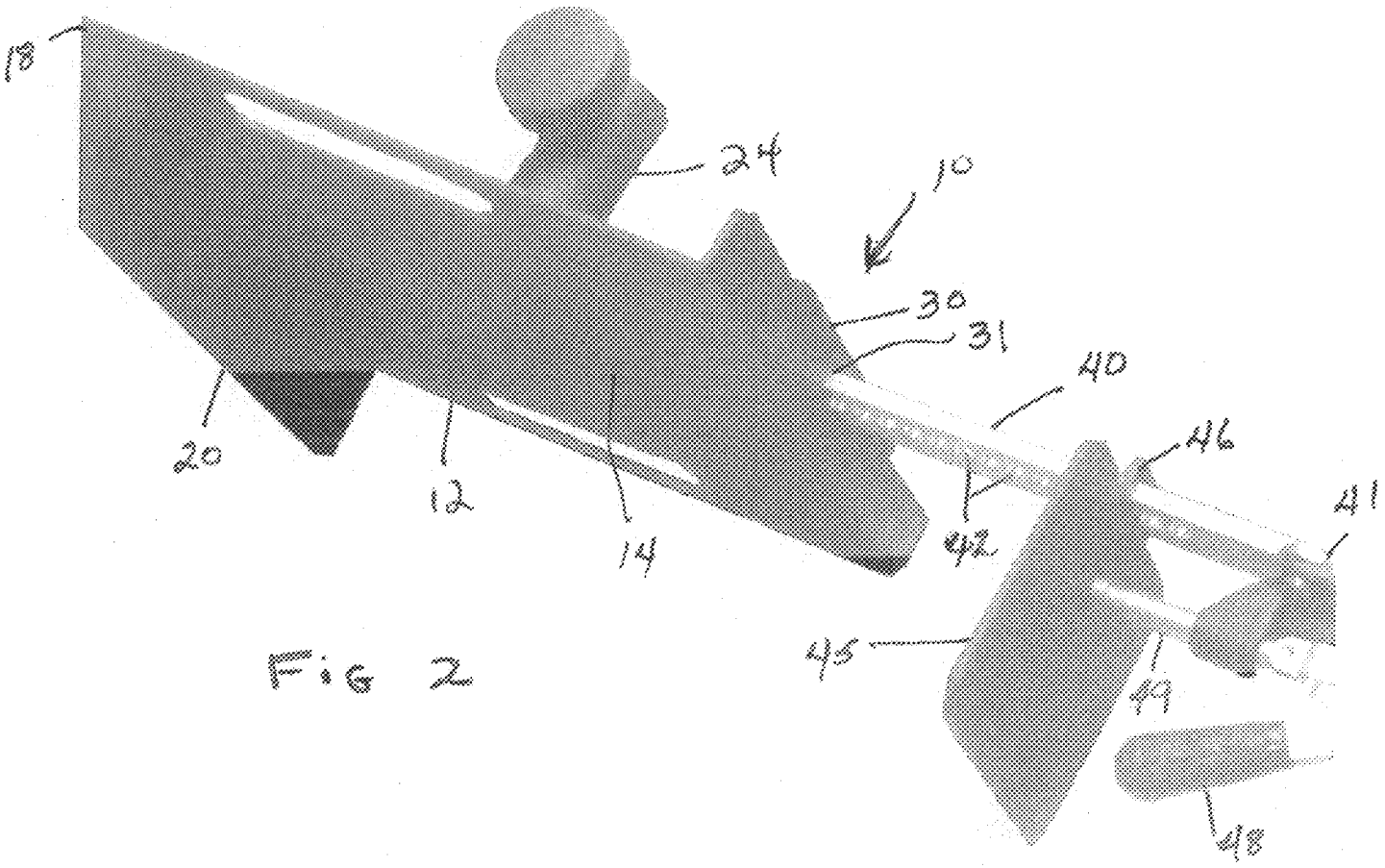
FIG. 2 shows the support platform in its open position with the moveable wall pulled to a full open position.

With specific reference to FIG. 1 and succeeding figures, the support fixture 10 of the present invention is generally illustrated. The support fixture 10 is formed by support platform 12, having a top surface 13 a bottom surface 14, opposed side edges 15 and 16 respectively, a front side 17 and a rear side 18. The rear side 18 is provided with a depending wall 20 which is fixedly secured along the length of the rear side 18. The top surface 13 of the support platform 12 is shown to be provided with a pair of opposed hand grasps 36 which provide convenient carrying apertures for the user. It will also be observed that the top surface 13 of the support platform 12 is provided with an upstanding support tube 24 mounted thereon and positioned essentially centrally of the support platform 12. A support tube 24 includes a base 25 which is in the form of a mounting column for mounting the support tube 24 to the top surface 13 of the support platform 12. It will be observed that the upstanding support tube 24 is substantially hollow interiorly, and include a threaded stop wheel 26 which is screw threaded through an appropriate aperture along one side of the support tube 24. The stop wheel 26 functions as a locking means for locking a bar within the confines of the upstanding support tube 24.

The front side 17 of the support platform 12 is provided with a bridge 30 which is mounted thereon and upstanding therefrom. The bridge has an open slot 31 formed therein for a purpose to be described hereinafter. A lock aperture 32 is formed substantially centrally of the bridge 30, and traverses the thickness of the bridge. The lock aperture 32 accommodates a lock pin 34 therethrough to accommodate a locking function as will be described.

Figure 7:
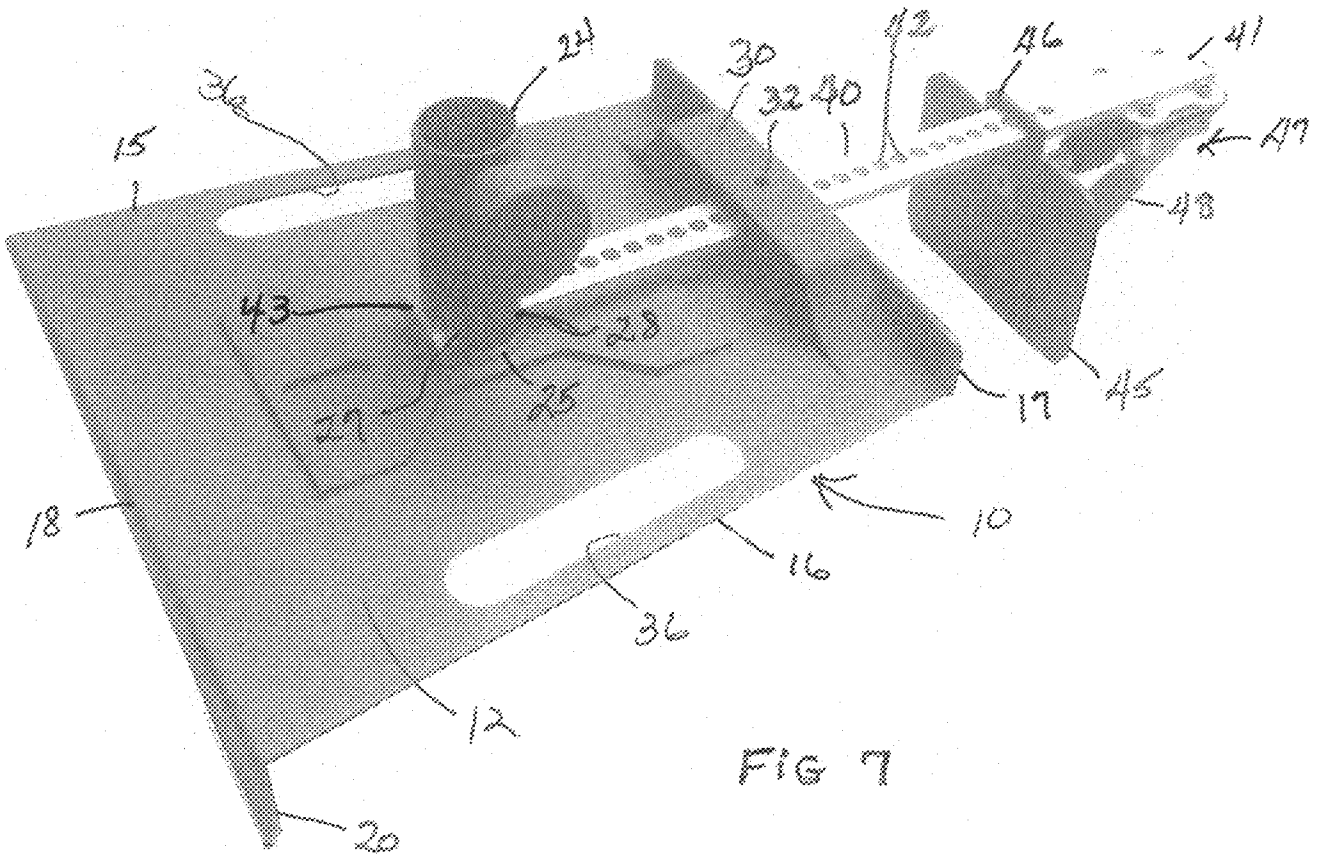
FIG. 7 is a plan view showing the support fixture in its fully open position.

The upstanding support tube 24 is also shown to include a pair of opposed slots 27 and 28 respectively (FIG. 7) which are in registry with the open slot 31 formed in bridge 30.

Figure 5:
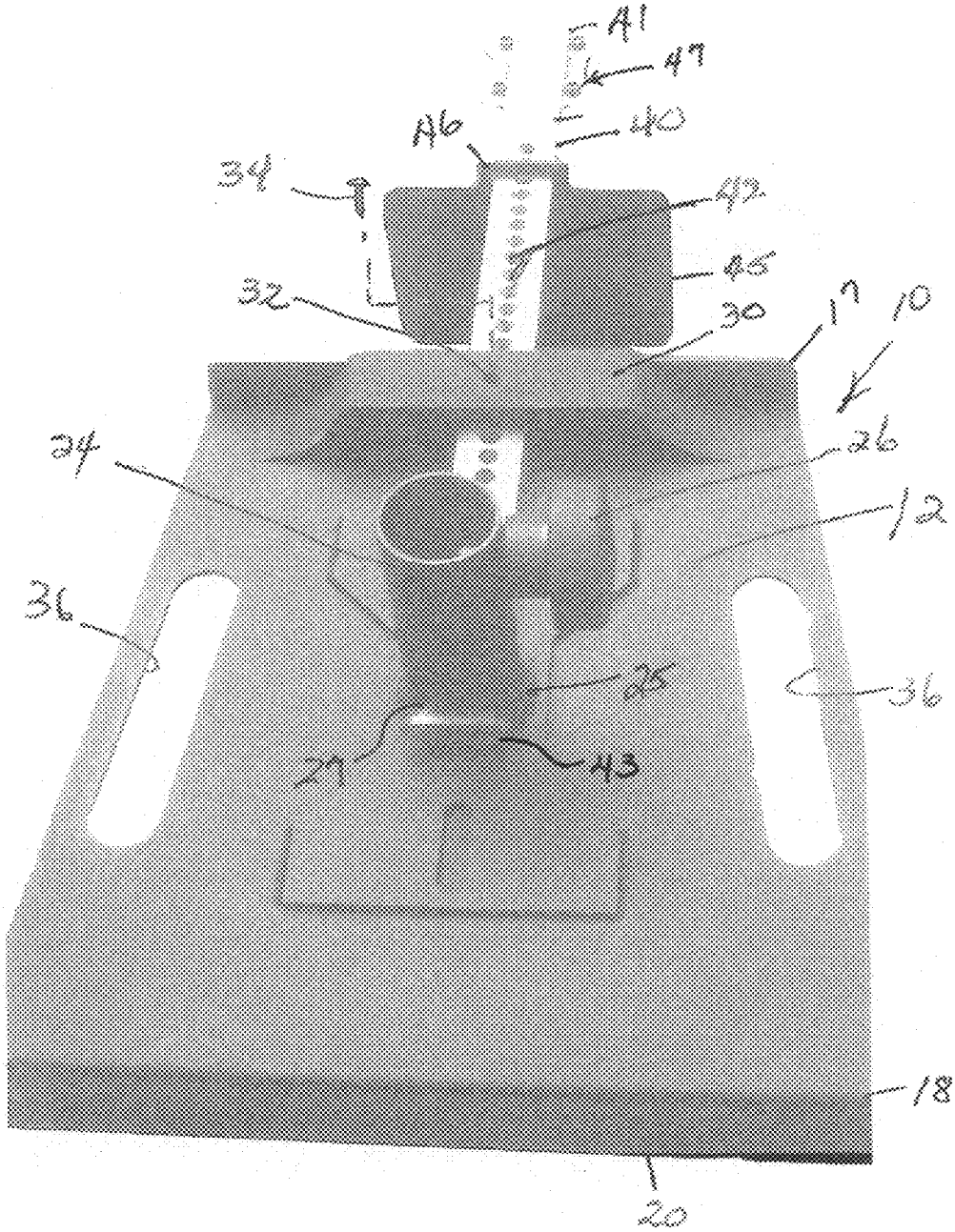
FIG. 5 is a plan view showing the support fixture of the present invention with the moveable wall in its pulled apart and spaced relation relative to the depending wall, and also shows the support tube extending upwardly from the top surface of the support plate, and a pair of opposed hand grasps for carrying the device.

It will be observed that a rod 40 is shown to be fitted within the open slot 31 of bridge 30 and passes through the opposed slots 27 and 28 in support tube 24. The rod 40 includes a plurality of apertures 42 which are linearly arranged along the length of the rod 40. It will be appreciated from a view of FIGS. 5 and 7, that the rod 40 may be locked into position under the bridge 30 by means of the lock pin 34 when the rod 40 is positioned in an appropriate lock position.

Figure 3:
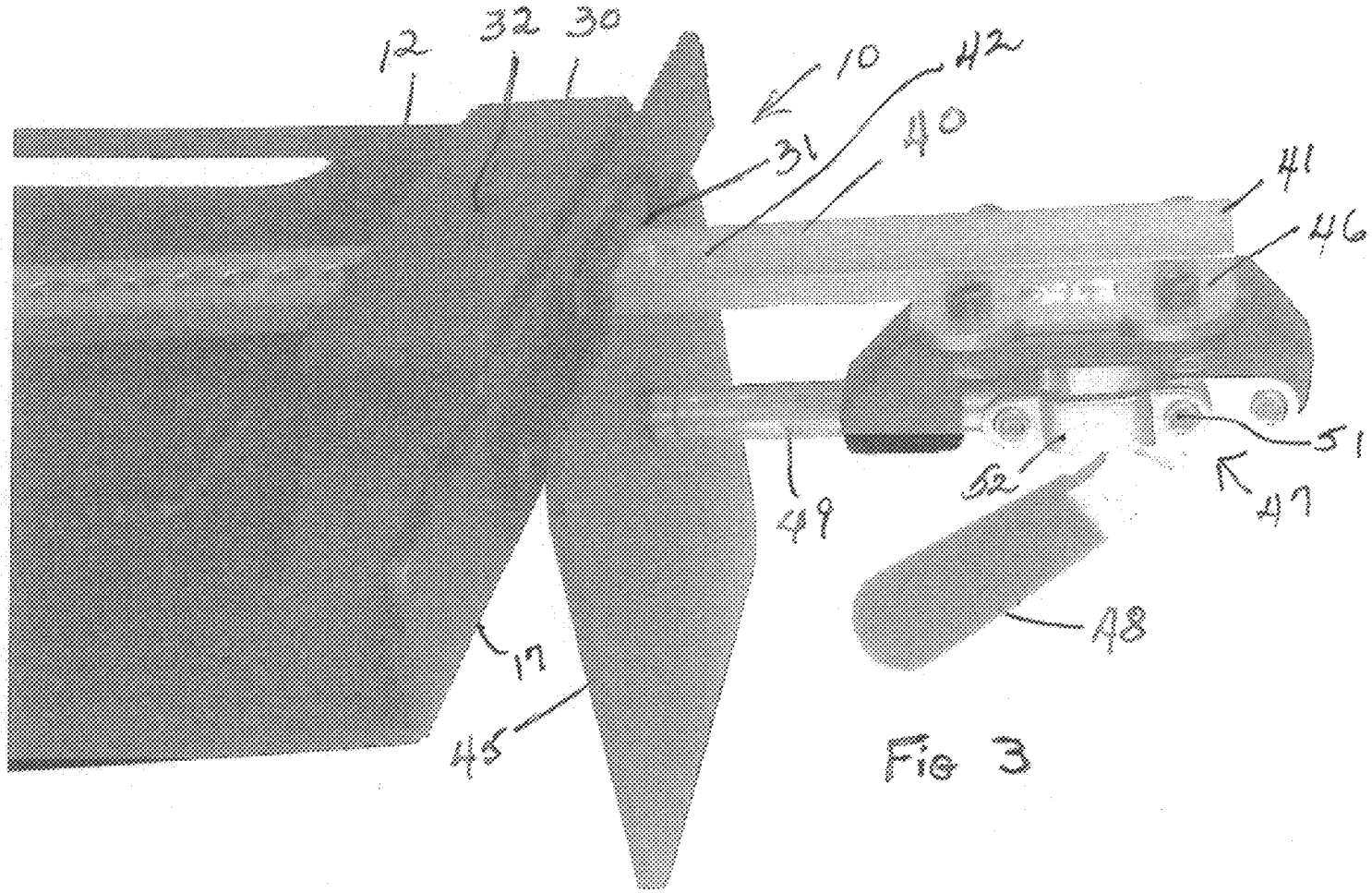
FIG. 3 shows the moveable wall in its fully closed position with the handle lock pulled to its locked position.
Figure 4:
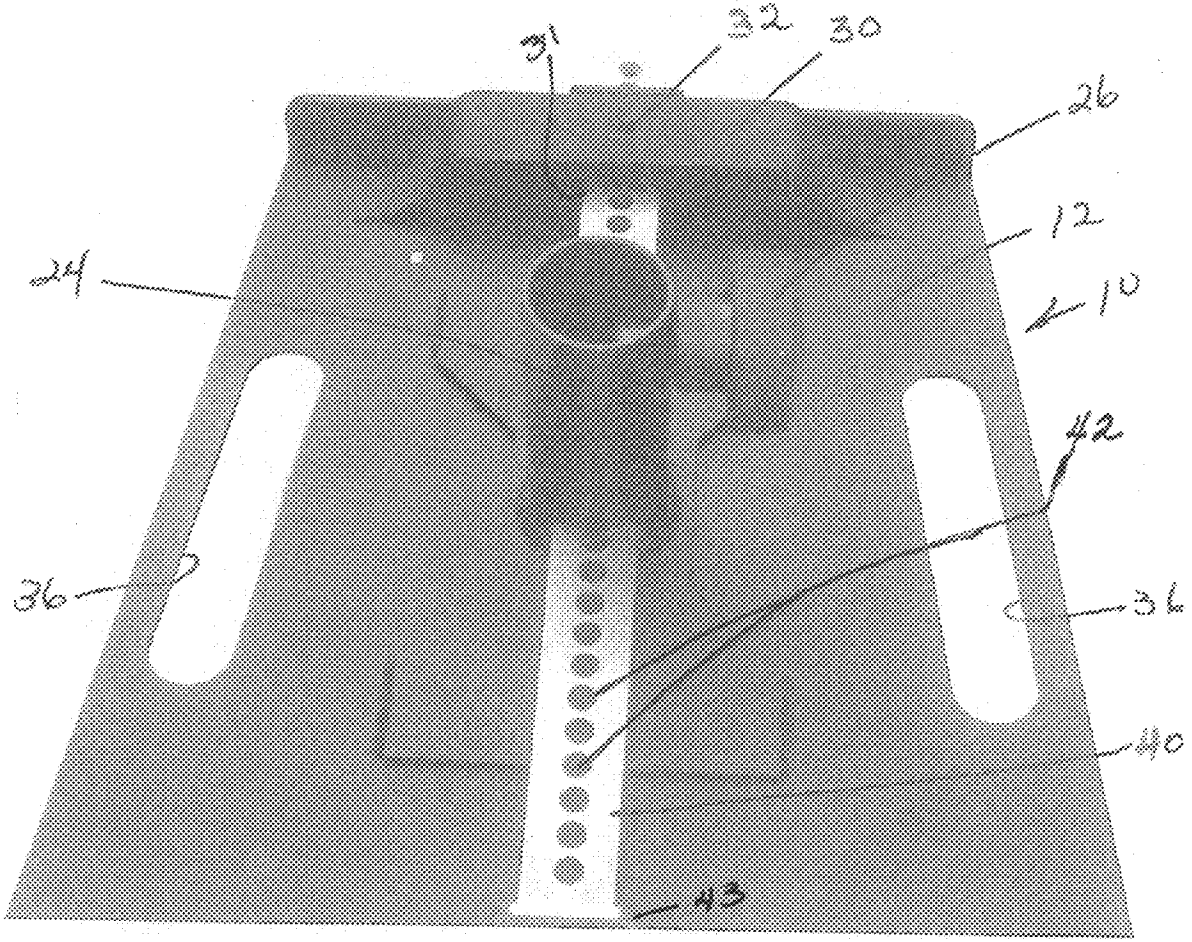
FIG. 4 is a top plan view showing the top surface of the support plate with the top support tube in position and with the rod in its horizontally moveable position thereon.

The rod 40 is provided with a depending moveable wall 45 which is mounted onto the rod 40 by means of an integral bracket 46. The outer end 41 of the rod 40 has a handle bracket 47 mounted thereon, which carries a handle 48 pivotally mounted to the handle bracket assembly 47. The handle manipulates a support bracket 49 which is, in turn, mounted to the depending moveable wall 45. It will be appreciated from FIGS. 3 and 6, that the handle 48 is designed to pivotally move the support rod 49 into a locked position once the depending moveable wall is locked onto an underlying support structure. The rod 40 is provided with a stop plate 43 at the back end thereof which keeps the rod from passing through the tube slots 27 and 28 respectively.

Figure 6:
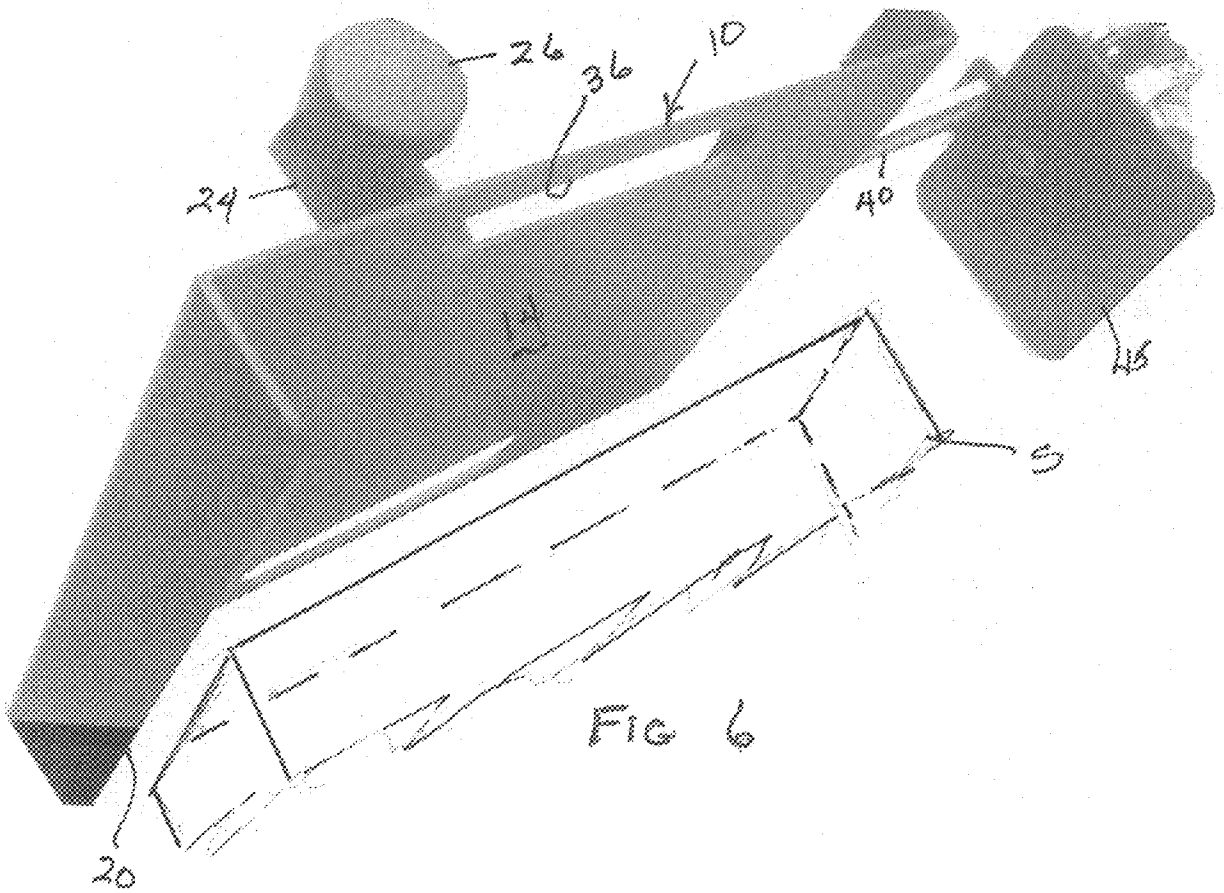
FIG. 6 is a perspective view showing the rear support plate with the moveable wall in its open position relative to the fixed depending wall and the manner of mounting the same on a speaker box.

As shown in FIG. 6, the support fixture 10 of the present invention is adapted for being placed in mounting position on top of a speaker box S by clamping the depending wall 20 over one side edge of the speaker box S, and then manipulating the moveable wall 45 via the handle bracket assemble 47 until the moveable wall 45 is up against the opposed side edge of the speaker box S. As was indicated previously, the handle bracket assembly 47 is designed to lockedly engage the depending moveable wall 45 against one side of the speaker box by simply manipulating handle 48 in a forward direction which causes the support rod 49 to move the depending moveable wall against the side of the speaker box. The handle bracket assembly 47 is merely a bracket 46 which holds the handle 48 via a pivot 51 which translates the locking motion via a yolk 52 which in turn in connected to the support rod 49. The assembly of the handle bracket assembly 47 is well known in the art and represents one of several different mechanical means for moving the depending moveable wall 45 into position and locking the same. For example, the handle 48 may be locked into its forward lock position by having a detent and a ridge (not shown) formed in the lower portion of the bracket 46. Once again, the construction of the handle bracket assembly 47 is not deemed particularly relevant to the present invention other than to provide means for advancing the moveable wall 45 forward and locking the same in its locked in position.

It is therefore clear that the support fixture 10 of the present invention may be lockingly engaged onto the top of a speaker box as illustrated in FIG. 6 of the drawings. It will also be appreciated that incident to the presentation of musical performances on stage, in order to present an array of sound to the audience, a number of speaker boxes are usually provided to accommodate various arrangements and frequencies of sound. A support fixture 10 in accordance with the present invention may be provided for mounting on each and every one of the speaker boxes such that an array of special lighting assemblies may be mounted as desired. It will further be appreciated that the speaker boxes S are usually located in positions on stage which are designed to be in a non-obstructive position relative to the view of the audience. In this manner, the audience is permitted to view the performers on stage. This also facilitates the position of the special lighting effects which are usually adapted to be again, positioned in non-obstructive positions on stage in order to create the special effects. Hence, the present invention permits the producers of the performance to minimize the amount of stage space occupied by extraneous items such as speaker boxes, and the tripods presently necessary to carry an array of special lighting effects.

It will further be appreciated from the above description that since the support fixture 10 of the present invention is adjustable, it will mount onto any variety size speaker boxes as may exist.

It will further be indicated that in most cases, a special lighting bar which contains special lights and the like generally has a depending tubular support which is carried by a tripod and hence, no special adaptations are necessary in order to mount a special effect lighting bar to the support fixture 10. The tube will simply be installed within the upstanding support tube 24 after which the stop wheel 26 is screw-threadedly locked into position onto the tube supporting the array of lights.

It will appreciated from the above description that the present invention provides a convenient and economical device for carrying and supporting special effects lighting in connection with a live stage performance generally of a musical nature. The present eliminates the need for extraneous tripod arrangements and therefore, minimizes space required on stage for the various devices necessary and incident to the presentation of a live performance.

While there has been described what is considered to be the preferred embodiment of the present invention, it will be understood that various modifications may be made therein without the parting for the true spirit and scope of the present invention.

The invention claimed is:

1. An adjustable support fixture for supporting and mounting an array of accessory devices to an underlying support structure comprising, a support platform bounded by a front and rear side and having opposed side edges, a top surface and a bottom surface, a depending wall formed along one side edge of said platform, a support bridge secured to the top surface of said platform and positioned opposite to said depending wall, said bridge having an open slot thereunder, a support tube having a base mounted on the top surface of said platform and in spaced apart relation relative to said support bridge, said support tube having opposed slots formed in said base thereon, said opposed slots being in spaced apart registry with said bridge slot, a rod having a forward end and rear end positioned within and extending through said bridge slot and opposed base slots so as to be horizontally moveable therethrough, a support plate carried on and depending from said rod adjacent the forward end thereof and positioned to be opposite from said depending wall of said platform when in use, said support plate being laterally moveable along said rod, a stop plate mounted on the rear end of said rod, lock means associated with said bridge and corresponding lock engagement means associated with said rod to permit said rod to be locked into any desired position under said support bridge, whereby said support plate form may be mounted on an appropriate underlying support structure by positioning the underlying support surface between said depending wall and said support plate, and locking said lock means in place and mounting an array of accessory devices in said support tube sized to be positioned above said underlying support structure.

2. The adjustable support fixture as set forth in claim 1 above, wherein said support plate is secured to a locked handle for locking said support plates in position when mounted on the underlying support structure.

3. The adjustable support fixture as set forth in claim 1 above, wherein said lock means associated with said bridge comprises a lock pin aperture and said lock engagement means associated with said rod comprises a series of linearly arranged pin receiving apertures, said bridge pin aperture and pin receiving apertures being in registry along the length of said rod, and a lock pin for insertion through said bridge lock pin aperture and into one of said rod pin receiving apertures thereby to lock said rod relative to the said bridge when said rod is adjusted to its mounting position.

4. The adjustable support fixture as set forth in claim 1 above, wherein said rod is further provided with a lock handle assembly comprising a handle mounted to said rod, a lock bar mounted at one end to said handle and mounted at the opposed end to said support plate, whereby said handle and lock bar will lockingly engage said support plate onto an underlying support structure when said support plate is positioned in mounting relationship to the underlying support structure.

5. The adjustable support fixture as set forth in claim 1 above, wherein said support tube further includes locking means associated therewith, said locking means adapted to lock the array of accessory devices mounted therein.

6. The adjustable support fixture as set forth in claim 5 above, wherein said lock means associated with said support tube comprises a threaded aperture positioned along and through said support tube, and a stop wheel screw threadedly mounted through said threaded aperture, whereby the array of accessory devices inserted in said support tube may be lockingly engaged therein by screw threading said stop wheel into said threaded aperture of said support tube until said stop wheel contacts and locks the array of accessory devices therein.

7. The adjustable support fixture as set forth in claim 1 above, wherein said support platform is further provided with carrying means for accommodating the carrying of said support fixture.

8. The adjustable support fixture as set forth in claim 7 above, wherein said carrying means comprises at least one elongated aperture formed into the surface of said support platform thereby to provide the a grip aperture for the user.

* * * * *